United States Patent [19]

Croes et al.

[11] 4,232,999

[45] Nov. 11, 1980

[54] SUPERCHARGERS FOR INTERNAL COMBUSTION ENGINES

[75] Inventors: Nicolaus Croes, Baarn, Netherlands; Hansulrich Hörler, Zurich; Hubert Kirchhofer, Gebenstorf, both of Switzerland

[73] Assignee: BBC Brown, Boveri & Company, Limited, Baden, Switzerland

[21] Appl. No.: 932,954

[22] Filed: Aug. 11, 1978

Related U.S. Application Data

[63] Continuation-in-part of Ser. No. 722,420, Sep. 13, 1976, abandoned.

[30] Foreign Application Priority Data

Oct. 10, 1975 [CH] Switzerland ..... 13198/75

[51] Int. Cl.[3] ..... F04F 11/02

[52] U.S. Cl. ..... 417/64; 123/559

[58] Field of Search ..... 417/64; 60/39.45; 123/119 C

[56] References Cited

U.S. PATENT DOCUMENTS

| | | | |
|---|---|---|---|
| 3,120,920 | 2/1964 | Waleffe et al. | 417/64 |
| 3,776,663 | 12/1973 | Croes | 417/64 |

FOREIGN PATENT DOCUMENTS

| | | | |
|---|---|---|---|
| 378595 | 6/1964 | Switzerland | 60/39.45 |
| 940937 | 11/1963 | United Kingdom | 60/39.45 |

[1]*Primary Examiner*—Louis J. Casaregola
*Assistant Examiner*—Edward Look
*Attorney, Agent, or Firm*—Burns, Doane, Swecker & Mathis

[57] ABSTRACT

A supercharger for an internal combustion engine has a rotor provided with cells, and two side housing portions. One side housing portion has a high pressure feed duct for the hot high-energy engine exhaust gas and a low pressure discharge duct for the expanded low-energy exhaust gas. The other side housing portion has a low pressure feed duct for the combustion air to be compressed and a high pressure discharge duct for the compressed combustion air. In at least one side portion there is formed a pocket open towards the rotor in a web between a high pressure duct and a low pressure duct. An opening is provided for feeding of fluid to the pocket without being influenced by the pressure-wave process in the cells. The cross-sectional area of the opening is dimensioned as a function of engine horsepower. The height of the opening is less than the height of the associated high pressure duct. One form of opening comprises an opening spaced from the rotor so that a web portion of the housing shields the opening from pressure waves generated by the rotor. Another form of opening comprises an opening arranged generally parallel to the gas flow and having its outlet in the pocket spaced sufficiently far from the rotor that there is no obstruction by pressure waves. Another form of opening means comprises an opening which is open toward the rotor, with the depth of the opening being sufficiently large that the outer portion of the opening is unobstructed by pressure waves.

11 Claims, 3 Drawing Figures

SUPERCHARGERS FOR INTERNAL COMBUSTION ENGINES

BACKGROUND AND OBJECTS OF THE INVENTION

This is a continuation-in-part of our earlier application Ser. No. 722,420 filed Sept. 13, 1976 now abandoned.

This invention relates to a gas-dynamic pressure-wave machine intended as a supercharge unit for an internal combustion engine.

Such supercharger machines may include a rotor provided with open-ended cells, a middle housing portion, and two side housing portions. One side housing portion comprises at least the high pressure feed duct for the hot high-energy engine exhaust gas, and at least one low pressure discharge duct for the expanded low-energy exhaust gas. The other side housing portion comprises at least one low pressure feed duct for the combustion air to be compressed, and at least one high pressure discharge duct for the compressed combustion air. In at least one side housing portion, a pocket open towards the rotor is provided in a web between a feed duct and a discharge duct.

In gas-dynamic pressure-wave machines, the expansion of one gas is used for raising the pressure of another gas. The gas-dynamic process is carried out under the influence of compression and expansion waves in the open-ended cells of the rotor, which pass by the feed and discharge ducts in the side housing portions.

Pressure wave machines of this type have been heretofore proposed, as evidenced by British Pat. No. 940,937, Swiss Pat. No. 378,595 and U.S. Pat. No. 3,120,920 issued to Waleffe et al on Feb. 11, 1964 and assigned to the assignee of this invention.

These patents deal in particular with the effects caused by reductions in the speed of a supercharger rotor and the resultant drop in low pressure scavenging. When the rotor speed drops, the pressure waves within the rotor can become misaligned relative to the ducts. It is proposed in those patents to provide a first pocket in a side wall of the supercharger between the high pressure outlet and the low pressure inlet and a second pocket in the other side wall between the high pressure inlet and the low pressure outlet. Communication is provided between the high pressure inlet and the second pocket so that a flow of exhaust gases is able to elevate the pressure of pressure waves in that region to provide sufficient low pressure scavenging during periods of low rotor speed. Therefore, ample low pressure scavenging of a pressure-wave machine is provided over a wider operating range, especially under partial loading, to prevent engine suffocation.

Another problem involving superchargers occurs when an engine is to be provided with a supercharger, but the particular operating characteristics of the engine (e.g., horsepower, rpm, etc.) do not correspond to the design parameters of available superchargers. Thus, the available superchargers are not designed to efficiently handle the quantity of exhaust gas generated by that particular engine. Of course, a new supercharger could be designed. However, in the mass production of pressure-wave machines, it is desirable, for reasons of standardization, that the geometry of each machine of a given machine type (rotor cross-section, rotor length, housing end surfaces for the inlet and outlet of the gases to or from the rotor) remain unchanged. The optimum performance graph for each machine type follows the performance graphs of neighboring types practically without overlapping. Adaptation of a pressure wave machine to a different engine has heretofore been possible only by varying the transmission ratio for the speed of rotation between the pressure-wave machine and engine, and/or by choice of type of pressure-wave machine.

For each pressure-wave machine there is a rotational speed-volume region in which sufficiently good supercharger characteristics are obtained for any loading, and in particular high relative densities for full load. By varying the transmission ratio for the speed of rotation, a pressure-wave machine may be adapted within a performance graph to different operating values of the compressed combustion air as required by the respective engine. In the boundary region of the performance graphs between two pressure-wave machines, it may, however, happen that neither a smaller nor a larger machine is adaptable to the engine type concerned.

If a smaller supercharger machine is to be used, it will operate on larger throughputs in its performance graph. Thus, the boost pressure is of necessity higher and the peak pressures in the engine may exceed an allowable value. Moreover, the rotor charge will be greater and, because of the increased heat transfer and reduced low pressure scavenging, the boost air temperature rises. (The rotor charge signifies the ratio between the penetration depth of the exhaust gas into the rotor and the rotor or cell length.)

If a larger machine is to be used, it will operate with smaller throughputs in its performance graphs. Thus, the boost pressure is of necessity smaller, but the compression efficiency is higher because of smaller rotor charge. Provided the boost air density does not fall too far, these larger machines are satisfactory from the supercharger aspect. However, for reasons of economy, and in some cases because of lack of space, engine designers tend not to think of the larger machine as absolutely necessary.

Therefore, it would be desirable to enable a smaller machine to be utilized. That is, the smaller machine must be capable of handling a larger throughput quantity of exhaust air so as to maintain acceptable peak pressures in the engine and prevent suffocation of the engine.

It is, therefore, an object of the invention to provide a pressure-wave machine which enables excess exhaust gas to be handled without passing through the normal pressure wave route in the rotor cells and without being obstructed by pressure waves generated within the rotor.

It is another object of the invention to provide a method for converting a pressure wave machine to handle high quantities of exhaust gas.

Another object of this invention is to provide a pressure-wave machine better adapted to the operating values of the compressed combustion air required for a given engine, without impairing the gas-dynamic process.

BRIEF SUMMARY OF THE INVENTION

According to this invention there is provided a gas-dynamic pressure-wave machine intended as a supercharger unit for an internal combustion engine, and consisting substantially of a rotor provided with cells, a middle housing portion, two side housing portions, one side portion of which comprises at least one high pressure feed duct for the hot high-energy engine exhaust gas, and at least one low pressure discharge duct for the expanded low-energy exhaust gas, and the other side portion of which comprises at least one low pressure feed duct for the combustion air to be compressed, and at least one high pressure discharge duct for the compressed combustion air, and in at least one side portion, a pocket open towards the rotor in a web between a feed duct and a discharge duct, and an opening means for feeding of excess fluid quantities to the pocket without being influenced by the pressure-wave process in the cells.

The opening means for feeding of fluid to the pocket without influence by the pressure-wave process in the cells can adapt the pressure-wave process finely to the operating values of the compressed combustion gas as required by a determined engine type.

By feeding high-pressure gas (this term signifying both hot exhaust gas and compressed combustion air) to a pocket, the performance graph of a pressure-wave machine may be displaced and its absorption capacity modified, without impairing the control characteristics of the pocket. The machine is therefore better adapted to the operating conditions of the engine, which thus works close to its optimum.

Embodiments of the invention will now be described, by way of example, with reference to the accompanying diagrammatic drawings, in which.

DETAILED DESCRIPTION OF PREFERRED EMBODIMENTS OF THE INVENTION

Figure 1:
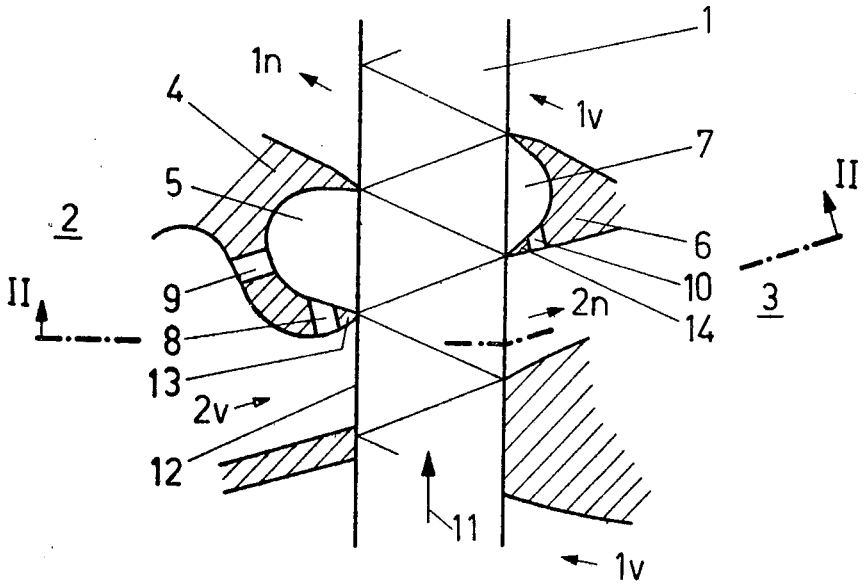
FIG. 1 is a part of the development of a cylindrical section through the rotor of a pressure-wave machine and through the neighboring parts of the housing side portions, with various possibilities of fitting openings between high pressure ducts and control pockets.

In FIG. 1, the rotor 1 of a pressure-wave machine moves in the direction of rotation indicated by the arrow 11 between the two side portions 2 and 3 of the housing. A side portion 2, also known as the gas housing, comprises the high pressure feed duct 2*v* for the hot high-energy exhaust gas and, proceeding in the direction of rotation of the rotor, the low pressure discharge duct 1*n* for the expanded low-energy exhaust gas. In the web 4 between the feed duct 2*v* and discharge duct 1*n* there is disposed the gas pocket 5 open towards the rotor.

A side portion 3, also known as the air housing, comprises the high pressure discharge duct 2*n* for the compressed combustion air and, proceeding in the direction of rotation of the rotor, the low pressure feed duct 1*v* for the combustion air to be compressed. In the web 6 between the discharge duct 2*n* and feed duct 1*v* there is disposed an expansion pocket 7 open towards the rotor. (The specification of the duct sequence in the direction of rotation of the rotor, and with it the stipulation of the webs under consideration, is necessary because in two or three cycle machines, a correspondingly large number of feed and discharge ducts are present in each side portion, these being disposed alternately).

The pressure-wave machine is to be utilized in conjunction with an engine that has a larger horsepower, and hence a larger exhaust capacity, than that for which the machine thusfar described has been designed. The entry of the excessive exhaust gases from the engine into the supercharger could stifle the former. A larger supercharger could be used but would be more expensive and would occupy more space.

In accordance with the present invention an opening 8 is provided in the wall between the feed channel 2*v* and gas pocket 5 in such a manner that the gas pocket is fed with hot exhaust gas under the static pressure in the feed duct. The gas is conducted in a direction transversely relative to the direction of gas flow in the duct 2*v*. The flow capacity of the opening 8 is determined in accordance with the quantity of exhaust gas to be supplied by the engine. That is, the cross-sectional area of the opening 8 is a function of the horsepower of the engine, among other parameters, such that the largest expected quantity of excessive exhaust gases (e.g., in excess of a predetermined amount for which the supercharger was originally designed) can be "dumped" through the opening and into the pocket 5. Gases from the pocket 5 enter the rotor and eventually pass through the low pressure outlet 1*n*. Thus the gases passing through the opening 8 are not discharged into the rotor directly from the feed channel 2*v*.

Gases passing through the opening 8 are protected from being blocked or obstructed by the pressure waves generated in the rotor, by the outer portion 13 of the wall separating the pocket from the feed channel 2*v*.

The operation is as follows. The absorption capacity of the pressure-wave machine is limited by the low pressure scavenging. The exhaust gas quantity entering the rotor cannot be increased to any desired amount. Provision must be made for releasing the exhaust gas again through the low pressure discharge duct. Thus sufficient low pressure scavenging must be guaranteed. Moreover, a too small rotor would be overcharged, leading to too high recirculation of exhaust gas into the combustion air, and a too high supercharger air temperature. Thus throughput increase can only be obtained by increasing scavenging action in the low pressure zone.

Instead of raising the speed of rotation or choosing a larger pressure-wave machine, the rotor charge is held within limits in spite of throughput increase, such that a certain exhaust gas quantity passes through the opening 8 of the gas pocket which is dimensioned as a function of engine exhaust capacity. The total high pressure exhaust gas quantity at the outlet of the high pressure feed opening 12 does therefore not have to be processed, i.e., does not pass through the end of the duct 2*v*. Thus the absorption capacity of the machine is higher and the exhaust gas quantity fed to the gas pocket increases the scavenging action in this pocket, so that the larger total high pressure exhaust gas quantity may actually be discharged through the low pressure discharge duct. The result is an increase in throughput volume at constant combustion air boost pressure, or, as the throughput volume in supercharging is determined by the rotational speed of the engine, a reduction in the combustion air pressure for given throughput volumes.

With regard to pressure lowering, the opening 8 may be used only up to a high pressure exhaust gas temperature of about 700° C. Moreover, the boost pressure rises as the gas pocket is supplied with gas from the cells and the gas from the pocket flows back into the high pressure feed duct. The opening 8 is distinguished particularly by causing very strong pressure variations for engine load changes. This is favorable for altitude compensation relative to supercharger air density, because the boost pressure rises strongly for small temperature rises.

An opening 9 may be disposed in the wall between the high pressure feed duct 2*v* and the gas pocket 5 such that the gas pocket is fed with hot high-energy exhaust gas by the dynamic pressure head in the feed duct in a direction generally parallel relative to the direction of gas flow in the duct 2*v*. The action is similar to that of the opening 8, but to a larger extent, which is indicated by a larger rise in throughput volume for constant combustion air boost pressure, or a larger fall in combustion air boost pressure for a given throughput volume. Moreover, with respect to pressure lowering, the opening 9 is operational to much higher exhaust gas temperatures than the opening 8.

The opening 9 is not shielded from the pressure waves generated by the rotor as is the opening 8, but rather is spaced sufficiently far from the rotor that the pressure waves are essentially dissipated at the outlet of opening 9 and thus do not interfere with gas flow therefrom.

An opening 10 may be disposed in the wall between the high pressure discharge duct 2*n* and the expansion pocket 7 such that the expansion pocket 7 is fed with compressed combustion air by the static pressure in the discharge duct. By this means the pressure in the discharge duct is lowered, or the absorption capacity of the pressure-wave machine is increased. On account of the resultant higher outflow velocity of the compressed combustion air from the cells into the discharge duct 2*n*, the rotor charge rises and the low pressure scavenging decreases, particularly during partial loading.

This disadvantage may be eliminated by a combination, i.e., by the simultaneous use, of the openings 10 and 8, or 10 and 9, because the rotor charge is again reduced by the influence of the gas pocket feed. Moreover, there is no upper temperature limit at which the opening 10, or the said combination with the opening 8 or 9, become ineffective in relation to pressure lowering. The opening 10, or the said combinations, are thus used with advantage where very high exhaust gas temperatures are expected, for example in supercharging precombustion chamber engines.

A portion 14 of the housing shields the opening 10 from interference by pressure waves from the rotor.

In principle, the openings 8 and 9, or all the openings 8, 9, and 10, may be combined with each other.

The action of the openings 8, 9, and 10 may be varied by their shaping, inclination and cross-section dimensions. The pressure-wave process reacts sensitively on the gas feed rate to the pockets. This feed must therefore not be distributed or influenced by the pressure-wave process in the rotor. As noted earlier, FIG. 1 shows that the openings 8 and 9 are separated from the rotor cells by the wall portions 13 and 14, respectively, and the opening 9 is at a sufficient distance from the end of the rotor for the gas feed to the pockets not to be influenced by the pressure-wave process in the rotor.

If the openings are produced during the casting of the housing, or prepared by machining, it may be an advantage to dispose them directly opposite the ends of the rotor without wall portions therebetween. In this case the openings should be formed in such a manner that they extend in an axial direction (i.e., perpendicular to the plane of the rotor chamber) sufficiently outwardly away from the rotor ends so that the outer end of the opening is not obstructed by pressure waves from the rotor chamber.

Figure 2:
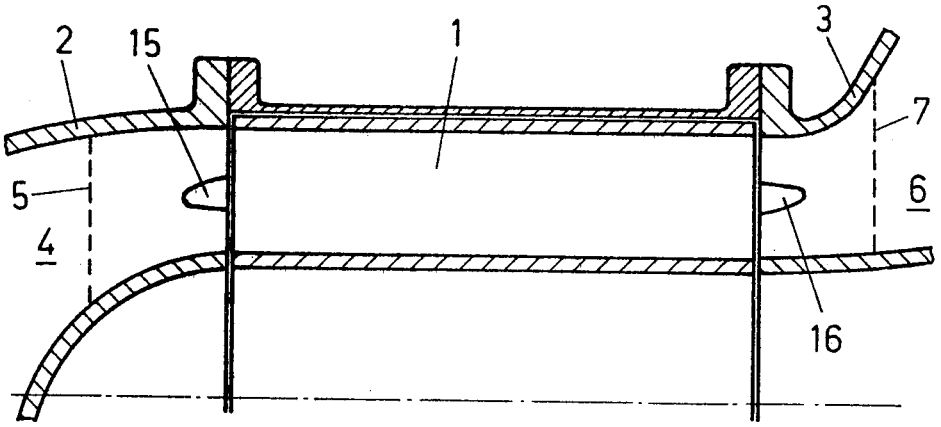
FIG. 2 is a longitudinal section of the machine on line II—II of FIG. 1, to a larger scale and with a different opening arrangement.

Such openings are shown in FIG. 2. The illustrated section includes a view of the web 4 in which the gas pocket 5 is disposed. The opening 15 (which may be imagined as an opening 8 opens toward the rotor 1) connects the high pressure feed duct 2*v* lying in front of the web 4 in FIG. 2 with the gas pocket 5. Likewise, the opening 16 which may be provided in lieu of or in addition to the opening 15, connects the high pressure discharge duct 2*n* with the expansion pocket 7 disposed in the web 6.

Since the inner end of the opening 15 (or 16) (i.e., the end opening into the rotor chamber) is not shielded by a part of the housing, pressure waves will enter the opening and interfere with gas travel through the region thereof adjacent the inner end. Accordingly, the opening 15 is extended sufficiently far from the rotor chamber in an axial direction that the pressure waves become dissipated, allowing gas to travel essentially unobstructed through the outer end of the opening. Accordingly, the opening 15 is of a size greater than that needed to handle the engine exhaust gas flow to allow for a portion of the opening to be blocked by the pressure waves.

Figure 3:
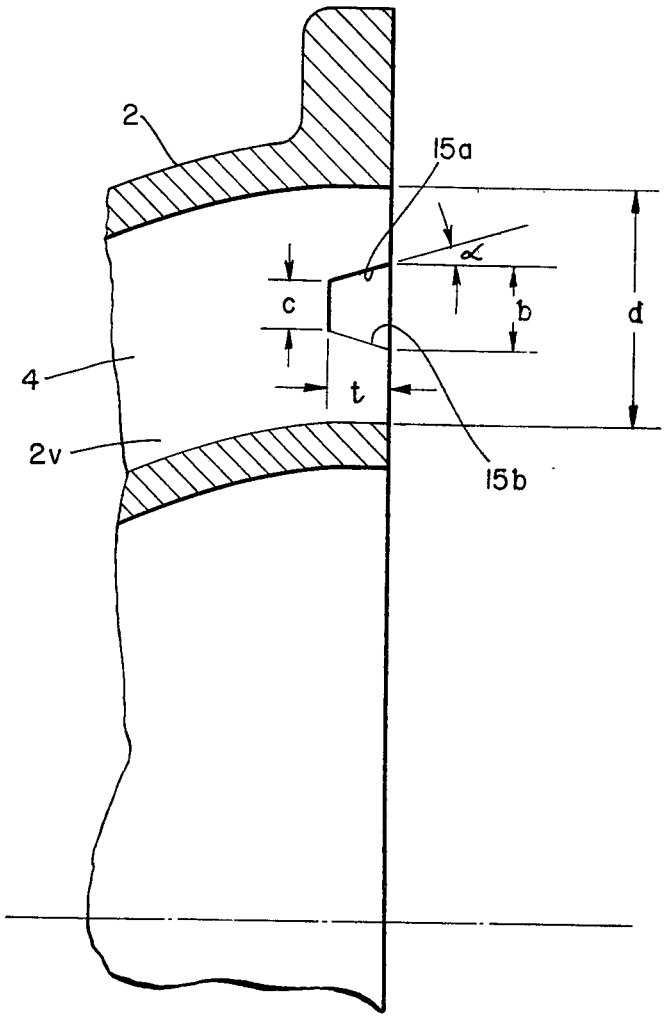
FIG. 3 is a fragmentary view of another form of opening arrangement similar to that depicted in FIG. 2.

A preferred embodiment of the pressure-wave machine is depicted in FIG. 3 to be utilized in conjunction with a diesel engine having a horsepower of 350 nominal output at nominal 2200 rpm. The supercharger rotor is driven at 8000 rpm and includes a rotor whose diameter is 200 mm. An opening 15*a* is formed in the wall of the housing separating duct 2*v* from the pocket 5, which opening opens toward the rotor. The maximum height b of the inner end of the opening 15*a* is 18 mm, substantially less than the diameter of the duct 2*v*. The minimum height c of the outer end of the opening 15*a* is 10 mm. The walls 15*b* of the opening each extend at an angle x of 15° relative to the axis of the outlet of duct 2*v*. The depth or thickness t of the opening is 15 mm.

An opening similar to 15*a* can be formed in the other side of the rotor housing, interconnecting duct 2*n* with pocket 7.

It is most preferable that the maximum height b of the opening 15, 15*a*, 16 be less than the height (diameter) of the ducts 2*v*, 2*n*. Preferably, the ratio of the maximum height b to the height d of the duct is in the range of $\frac{1}{3}$ to $\frac{1}{2}$. Preferably, the ratio of the thickness t to the minimum height c is in the range of 1 to 1.5.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In a supercharger for an internal combustion engine, the supercharger being of the gas-dynamic pressure-wave type comprising first and second spaced housing portions forming a rotor chamber therebetween, a rotor mounted for rotation in said rotor chamber, said rotor comprising a plurality of open-ended cells, a high pressure feed duct disposed in said first housing portion for conducting hot high-pressure engine exhaust gas into said rotor cells, a low pressure discharge duct disposed in said first housing portion for conducting expanded low-energy exhaust gas, a low pressure feed duct in said second housing portion for conducting combustion air to be compressed, a high pressure discharge duct disposed in said second housing portion for conducting combustion air compressed by said high pressure exhaust gas in said rotor cells, a pocket formed in at least one of said housing portions between said high and low pressure ducts thereof, said pocket being open toward the rotor chammber and separated from said adjacent high pressure duct by a wall portion of the associated housing portion, the improvement wherein an opening is formed in said wall portion between the associated pocket and high pressure duct for conducting fluid from the latter to the former in a direction transversely of the direction of travel of fluid in said last-named high-pressure duct, said opening being open toward said rotor chamber and having a height less than the height of said last-named high-pressure duct, said opening including a depth of sufficient magnitude that the outer portion of said opening remote from said rotor chamber is essentially unobstructed by pressure waves from said rotor cells, the cross-sectional area of said opening being dimensioned to conduct fluid quantities in excess of a predetermined amount from said last-named high-pressure duct.

2. Apparatus according to claim 1, wherein said pocket is formed in said first housing portion, said last-named high-pressure duct comprises said high-pressure feed duct.

3. Apparatus according to claim 1, wherein said pocket is formed in said second housing portion, said last-named high-pressure duct comprises said high pressure discharge duct.

4. Apparatus according to claim 1, wherein the ratio of the maximum height of said opening to the height of said high pressure duct is in the range of from 1:3 to 1:2.

5. In a supercharger for an internal combustion engine, the supercharger being of the gas-dynamic pressure-wave type comprising first and second housing portions forming a rotor chamber therebetween, a rotor mounted for rotation in said chamber, said rotor comprising a plurality of open-ended cells, a high pressure feed duct disposed in said first housing portion for conducting hot high-pressure engine exhaust gas into said rotor cells, a low pressure discharge duct disposed in said first housing portion for conducting expanded low-energy exhaust gas, a low pressure feed duct in said second housing portion for conducting combustion air to be compressed, a high pressure discharge duct disposed in said second housing portion for conducting combustion air compressed by said high pressure exhaust gas in said rotor cells, a pocket formed in at least one of said housing portions between said high and low pressure ducts thereof, said pocket being open toward the rotor chamber and separated from said adjacent high pressure duct by a wall portion of the associated housing portion, the improvement wherein an opening is formed in said wall portion between the associated pocket and high-pressure duct for conducting fluid from the latter to the former in a direction transversely of the direction of travel of fluid in said last-named high-pressure duct, said opening being spaced from said rotor chamber such that a section of said wall portion shields said opening from pressure waves generated in said rotor cells, the height of said opening being less than the height of said last-named pressure duct, and the cross-sectional area of said opening being dimensioned to conduct fluid quantities in excess of a predetermined amount from said last-named high-pressure duct.

6. Apparatus according to claim 5, wherein said pocket is formed in said first housing portion, said last-named high-pressure duct comprises said high-pressure feed duct.

7. Apparatus according to claim 5, wherein said pocket is formed in said second housing portion, said last-named high pressure duct comprises said high-pressure discharge duct.

8. Apparatus according to claim 7, wherein an additional pocket is formed in said first housing portion between said high-pressure feed duct and said low-pressure discharge duct, said pocket being open toward the rotor chamber and separated from said high-pressure feed duct by an additional wall portion of said first housing portion, an additional opening formed in said additional wall portion between said additional pocket and said high-pressure feed duct for conducting gas from the latter to the former in a direction generally parallel to the direction of travel of gas in said high-pressure feed duct, said additional opening including an outlet disposed in said additional pocket at a location sufficient far from said rotor chamber that gas discharged through said outlet is essentially unobstructed by pressure waves from said rotor cells, the height of said additional opening being less than the height of said high pressure feed duct, the cross-sectional area of said additional opening being dimensioned to conduct gas quantities in excess of a predetermined amount from said high-pressure feed duct.

9. In a supercharger for an internal combistion engine, the supercharger being of the gas-dynamic pressure-wave type comprising first and second spaced housing portions forming a rotor chamber therebetween, a rotor mounted for rotation in said rotor chamber, said rotor comprising a plurality of open-ended cells, a high-pressure feed duct disposed in said first housing portion for conducting hot high-pressure engine exhaust gas into said rotor cells, a low pressure discharge duct disposed in said first housing portion for conducting expanded low-energy exhaust gas, a low pressure feed duct in said second housing portion for conducting combustion air to be compressed, a high-pressure discharge duct disposed in said second housing portion for conducting combustion air compressed by said high-pressure exhaust gas in said rotor cells, a pocket formed in at least one of said housing portions between said high and low pressure ducts thereof, said pocket being open toward the rotor chamber and separated from said adjacent high-pressure duct by a wall portion of the associated housing portion, the improvement wherein an opening is formed in said wall portion between the associated pocket and high-pressure duct for conducting fluid from the latter to the former in a direction generally parallel of the direction of travel of fluid in said last-named high-pressure duct, said opening including an outlet disposed in said pocket at a location sufficiently far from said rotor chamber that fluid discharged through said outlet is essentially unobstructed by pressure waves from said rotor cells, the height of said opening being less than the height of said last-named high-pressure duct, the cross-sectional area of said opening being dimensioned to conduct fluid quantities in excess of a predetermined amount from said last-named high-pressure duct.

10. Apparatus according to claim 9, wherein said pocket is disposed in said first housing portion, said last-named high-pressure duct comprises said high pressure feed duct.

11. Apparatus according to claim 9, wherein the ratio of the maximum height of said opening to the height of said high-pressure duct is in the range of from 1:3 to 1:2.

* * * * *